US007934283B2

(12) United States Patent
Fleischer et al.

(10) Patent No.: US 7,934,283 B2
(45) Date of Patent: May 3, 2011

(54) GANGWAY LATCH

(75) Inventors: Corey A. Fleischer, Columbia, MD (US); William Russell Kraft, II, Forest Hill, MD (US); Alexander C. Boon, Baltimore, MD (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 12/550,003

(22) Filed: Aug. 28, 2009

(65) Prior Publication Data

US 2009/0313770 A1 Dec. 24, 2009

Related U.S. Application Data

(63) Continuation-in-part of application No. 12/370,261, filed on Feb. 12, 2009.

(60) Provisional application No. 61/028,161, filed on Feb. 12, 2008.

(51) Int. Cl.
*E01D 1/00* (2006.01)
*B63B 27/00* (2006.01)

(52) U.S. Cl. ..... 14/71.1; 14/69.5; 114/362

(58) Field of Classification Search ..... 14/69.5–71.5; 114/362

See application file for complete search history.

(56) References Cited

U.S. PATENT DOCUMENTS

| | | | | |
|---|---|---|---|---|
| 2,641,785 | A * | 6/1953 | Pitts et al. | 14/71.1 |
| 2,803,841 | A | 8/1957 | Wellens | |
| 4,011,615 | A * | 3/1977 | Maxson et al. | 14/71.1 |
| 4,083,072 | A | 4/1978 | Ryan | |
| 4,083,082 | A * | 4/1978 | Holmes | 16/288 |
| 4,133,283 | A * | 1/1979 | Ryan | 114/230.18 |
| 4,228,582 | A * | 10/1980 | Arai | 29/650 |
| 4,366,591 | A * | 1/1983 | Zimmerman | 14/71.3 |
| 5,135,076 | A | 8/1992 | Su | |
| 6,347,424 | B1 * | 2/2002 | Vatne | 14/69.5 |
| 6,955,134 | B2 * | 10/2005 | Prins | 114/230.17 |
| 7,331,302 | B2 * | 2/2008 | Secretan et al. | 114/117 |
| 2010/0032543 | A1 * | 2/2010 | Van Der Tempel et al. | 248/550 |

FOREIGN PATENT DOCUMENTS

FR 2465640 3/1981

(Continued)

OTHER PUBLICATIONS

Addie, Raymond W., "U.S. Appl. No. 12/370,261 Office Action Dec. 30, 2010", , Publisher: USPTO, Published in: US.

(Continued)

*Primary Examiner* — Raymond W Addie
(74) *Attorney, Agent, or Firm* — DeMont & Breyer, LLC

(57) ABSTRACT

A crew transfer system for transferring personnel from a vessel to a stationary platform, such as an oil rig, is disclosed. In the illustrative embodiment, the system includes a ramp that is coupled to the vessel and an interface that is attached to the stationary platform. The ramp is coupled to the vessel in such a way as to permit one translational and three rotational degrees of freedom at the vessel-end of the ramp. The ramp is coupled to the interface in such a way as to permit no translational and at least one rotational degree-of-freedom at the rig-end of the ramp with respect to the interface. The interface is rotatably coupled to the stationary platform in such a way as to permit a rotation of the interface about the yaw axis. Permitted rotation of the interface enables a range of acceptable angles of orientation between the vessel and the platform.

15 Claims, 5 Drawing Sheets

FOREIGN PATENT DOCUMENTS

| | | | |
|---|---|---|---|
| FR | 2586641 | B2 | 3/1987 |
| GB | 2246992 | A | 2/1992 |
| NL | 7203341 | A | 9/1973 |
| SU | 610718 | A1 | 6/1978 |

OTHER PUBLICATIONS

Raffaelli, Leonardo, "PCT Application No. PCT/US2009/033952 Aug. 13, 2010", , Publisher: PCT, Published in: PCT.

Addie, Raymond W., "U.S. Appl. No. 12/491,969 Office Action Dec. 17, 2010", , Publisher: USPTO, Published in: US.

Raffaelli, Leonardo, "PCT Application No. PCT/US2009/033952 International Search Report Apr. 8, 2010", , Publisher: PCT, Published in: PCT.

Deschanel, Sylvain, "AU Application No. 2009214641 Office Action Feb. 16, 2011 ", Publisher: IPA, Published in: AU.

* cited by examiner 502
504
704
702
714, 716
706
726, 728
710
708
116
712
112

502
736
738
734
L2
712

504
502
718
730
722
732
L1
728
726,
712

702
714, 716
502
718
724
722
720
710
712

GANGWAY LATCH

CROSS REFERENCE TO RELATED APPLICATIONS

This case is a continuation-in-part of co-pending U.S. patent application Ser. No. 12/370,261, filed 12 Feb. 2009, which claims priority of U.S. Provisional Patent Application U.S. 61/028,161, filed on Feb. 12, 2008, each of which is incorporated by reference herein.

If there are any contradictions or inconsistencies in language between this application and one or more of the cases that have been incorporated by reference that might affect the interpretation of the claims in this case, the claims in this case should be interpreted to be consistent with the language in this case.

FIELD OF THE INVENTION

The present invention relates to a system suitable for transporting personnel between a sea-faring vessel and a stationary or quasi-stationary platform, such as an oil rig, in high sea states.

BACKGROUND OF THE INVENTION

Safely and efficiently transporting personnel to oil platforms in the open ocean is a formidable challenge. In particular, wave heights of two to three meters and thirty-knot winds are not uncommon. In these conditions, transfer vessels experience pronounced heaving, pitching, and rolling motions, especially when they are at zero forward speed.

Traditionally, crews have been transferred to an oil rig via a crane-and-basket method or using a basket that is deployed from a helicopter. In the former method, personnel being transferred from a vessel step into or hang on to a basket that is suspended from a rig-mounted crane. The crane then hoists the basket and swings it over to the rig. In the latter technique, personnel are lowered from a helicopter on to the rig via a basket.

Used for the decades, both of these personnel-transfer methods involve certain risks. The usual accidents include lateral impacts, falling, hard landings, and water immersion.

Furthermore, the crane-and-basket method relies on the availability of the platform crane operator. A delay caused by the non-availability of a crane operator when needed results in down-time costs as well as an increase in the incidence of seasickness due to personnel spending an extended period time on a stationary but heaving/pitching/rolling transport vessel.

More recently, a gangway technique has been used wherein the free end of a ramp that is disposed on the oil rig is rotated toward and landed on a crew-transfer vessel. This technique is only suitable for use in relatively low sea states (e.g., sea state 2, etc.) since relatively higher sea states can cause substantial movement of the ramp. Such movement can present a safety risk to personnel that are using the ramp to transfer to an oil rig.

SUMMARY OF THE INVENTION

The present invention provides a crew transfer system that avoids some of the drawbacks and costs of the prior art. Among other advantages, the crew transfer system is useable to safely transfer personnel from a transfer vessel to stationary or quasi-stationary platform, such as an oil rig, in high sea states.

A crew transfer system in accordance with the illustrative embodiment of the present invention comprises a ramp, a first coupling for coupling a vessel end of the ramp and the transfer vessel, and a second coupling for coupling a rig end of the ramp and the stationary platform. The ramp is configured so that persons wishing to transfer between the vessel and the rig can simply walk across the ramp, even in high sea states.

In use, a first end (i.e., the vessel end) of the ramp is coupled, for translation and rotation, to the transport vessel via the first coupling. The first coupling comprises a "first mechanism" that imparts three rotational degrees-of-freedom to the first end of the ramp. The three rotational degrees-of-freedom permit the ramp to (1) pitch about a pitch axis of the ramp; (2) roll about a roll axis of the ramp; and (3) yaw about a yaw axis of the ramp. In the illustrative embodiment, the first mechanism includes a bearing and several pins that provide these three rotational degrees-of-freedom.

In the illustrative embodiment, the system further comprises a guide that is disposed on the transport vessel. In the illustrative embodiment, the guide is implemented as two rails. The first coupling further comprises a movable platform, wherein the first mechanism is disposed on the movable platform, and wherein the movable platform movably couples to the rails to provide the one translational degree of freedom to the first end of the ramp. In other words, the first end of the ramp is free to move along the rails towards the bow or stern of the transfer vessel.

The translational degree-of-freedom imparted by the moveable platform (and guide) prevents the first end of the ramp from moving laterally across the transfer vessel (i.e., prevents the end of the ramp from moving in the manner of a windshield wiper). The only translational motion of the first end of the ramp that is permitted by the system is along an axis that runs from bow to stern of the transfer vessel. In other words, the ramp is only permitted to move back and forth (i.e., a reciprocating movement) due to guide.

The second end (i.e., the rig end) of the ramp is rotationally coupled to the interface via the second coupling. The second coupling comprises a second mechanism that imparts a rotational degree-of-freedom about a pitch axis of the ramp to the second end of the ramp.

The present invention addresses an issue that can arise when the ramp is coupled with the stationary platform. Specifically, when coupled to the stationary platform, the weight of the ramp induces load (i.e., a downward force) on the second coupling that can make it difficult to disengage the second coupling when desired. This load can be exacerbated by motion of the transfer vessel relative to the platform. The difficulty in disengaging the second coupling can make it particularly difficult to quickly respond to an emergency situation, such as might be experienced when the transfer vessel is exposed to high sea-state conditions or a rogue wave. The present invention provides a second coupling that can be easily disengaged from the stationary platform while under load—during the deployment process or after it is fully deployed.

In the illustrative embodiment, the second coupling is configured to enable an actuation force to readily overcome a coupling force induced on the second coupling and thereby decouple the ramp and the stationary platform. The coupling force results from the load associated with the weight of the ramp. The second coupling comprises a latch that captures a coupling member, which depends from the stationary platform. The latch comprises a cam/latch that secures the coupling member when the cam/latch is in a first position. The latch further comprises an actuation lever that engages the cam/latch in response to the receipt of the coupling member by the cam/latch. When engaged with the cam/latch, the actuation lever inhibits rotation of the cam/latch to a second position in which the cam/latch can release the coupling member. The engaged actuation lever and cam/latch collectively define a substantially mechanically bistable system. As a result, a relatively small actuation force is sufficient to disengage the actuation lever from the cam/latch enabling the cam/latch to rotate to the second position and release the coupling member. In some embodiments, the actuation force required to actuate the latch is less than the coupling force.

An embodiment of the present invention is a system for transferring personnel or material from a transport vessel to a stationary platform at sea, wherein the system comprises: a ramp having a first end and a second end, wherein in use, the first end is coupled to the transport vessel and the second end is coupled to the stationary platform; a first coupling, wherein the first coupling couples together the first end and the transport vessel, and wherein the first coupling provides three rotational degrees-of-freedom and no more than one translational degree-of-freedom to the first end; and a second coupling for coupling the second end and the stationary platform, wherein the second coupling comprises a coupling member that depends from the stationary platform, and a latch for capturing the coupling member to couple the second end and the stationary platform, wherein the latch depends from the second end, and wherein a load force is induced on the latch when the second end and the stationary platform are coupled, and wherein the load force induces a coupling force that inhibits the release of the coupling member by the latch; wherein the second coupling is physically arranged to receive an actuation force that induces a decoupling force that is greater than the coupling force, and wherein the decoupling force enables the latch to release the coupling member.

DETAILED DESCRIPTION

This patent application is a continuation-in-part of U.S. patent application Ser. No. 12/370,261 filed 12 Feb. 2009 (the "parent application"), which described a crew transfer system that could be used to couple a transfer vessel to a stationary or quasi-stationary platform, located in a large body of water, to effect the transfer of personnel or cargo. The crew transfer system comprises a ramp having a first end that, when in use, is coupled with the transfer vessel and a second end that, when in use, is coupled with the stationary platform. When the ramp and stationary platform are coupled, however, a load force on the coupling between them is induced. This load force can make it difficult to decouple the ramp from the stationary platform—particularly when the transfer vessel is subject to high sea state conditions.

The present invention augments the disclosure of the parent application by disclosing an improved coupling system for coupling the ramp to the stationary platform. Specifically, the present invention discloses a latch that can readily disengage a coupling member deployed from the stationary platform, while the latch is subject to the load force induced by the coupled ramp and stationary platform. The latch enables a relatively low actuation force to decouple the ramp and the stationary platform.

In the illustrative embodiment, the crew transfer system is used to transfer personnel from a transfer vessel to an oil rig in the open ocean. It will be understood that the invention can be used to transfer personnel from a vessel to any stationary or quasi-stationary platform on the ocean. In conjunction with the present disclosure, those skilled in the art will be able to adapt the illustrative embodiment of the crew transfer system, as described below and depicted in the accompanying drawings, for use in coupling most transfer vessels to most stationary or quasi-stationary platforms to effect transfer of personnel.

Figure 1:
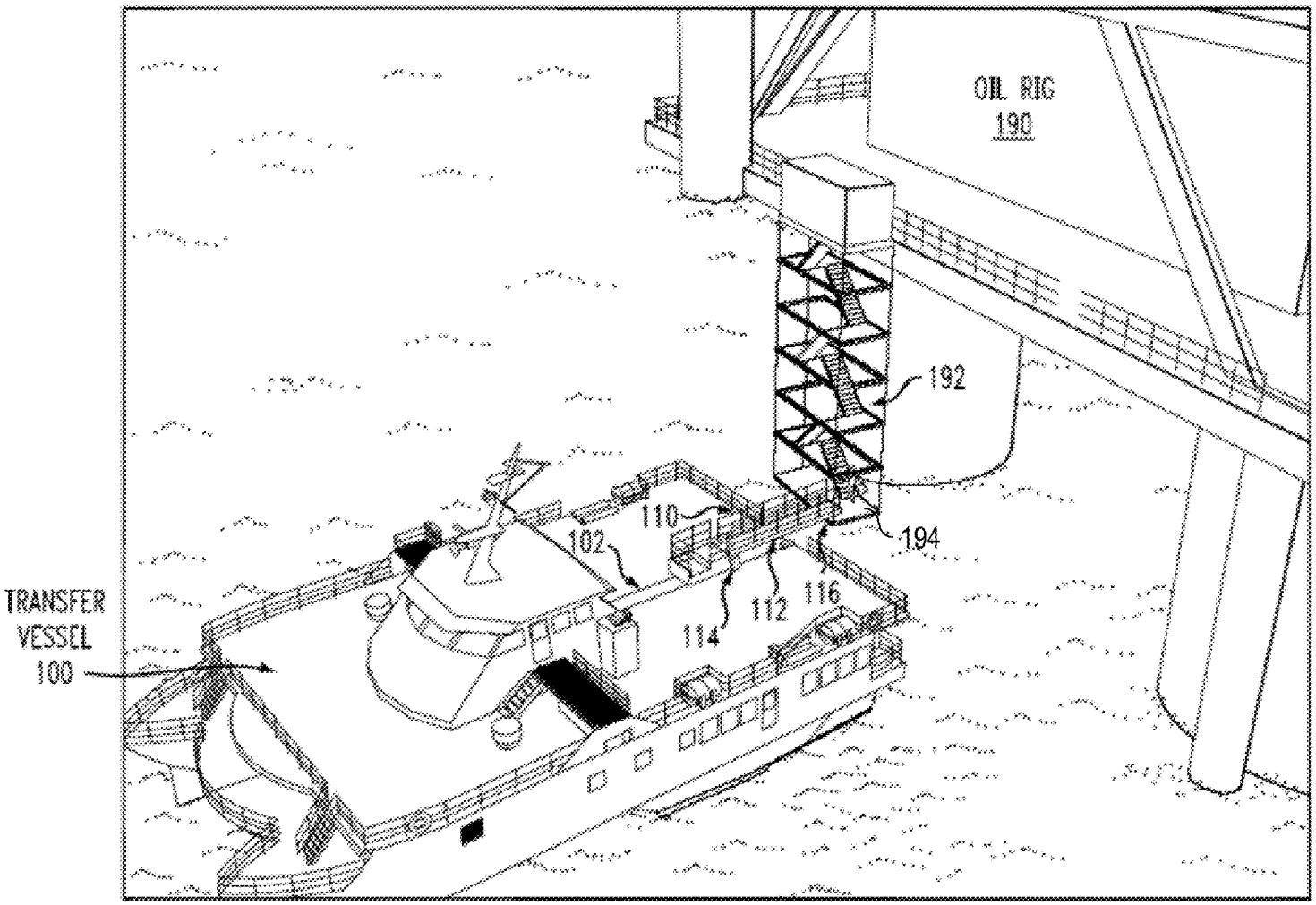
FIG. 1 depicts a crew transfer system in accordance with an illustrative embodiment of the present invention.

Turning now to the Figures, FIG. 1 depicts a "bridge" being formed between transfer vessel 100 and oil rig 190 via a crew transfer system, generally indicated at "110," in accordance with an illustrative embodiment of the present invention. Crew transfer system 110 comprises ramp 112, a first coupling 114, and a second coupling 116 (details of the couplings are not shown in FIG. 1).

First coupling 114 couples a "first" or "vessel" end of ramp 112 to transfer vessel 100 and second coupling 116 couples a "second" or "rig" end of ramp 112 to oil rig 190. In the embodiment that is depicted in FIG. 1, second coupling 116 couples the rig end of the ramp to the bottom of stairs 192.

Figure 2B:
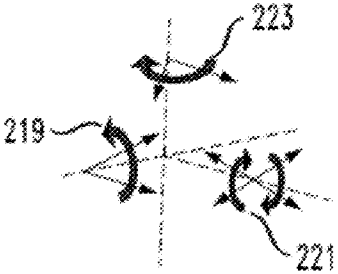
FIG. 2B depicts the three rotational axes about which rotation of the vessel-end of the ramp is free to occur.
Figure 2A:
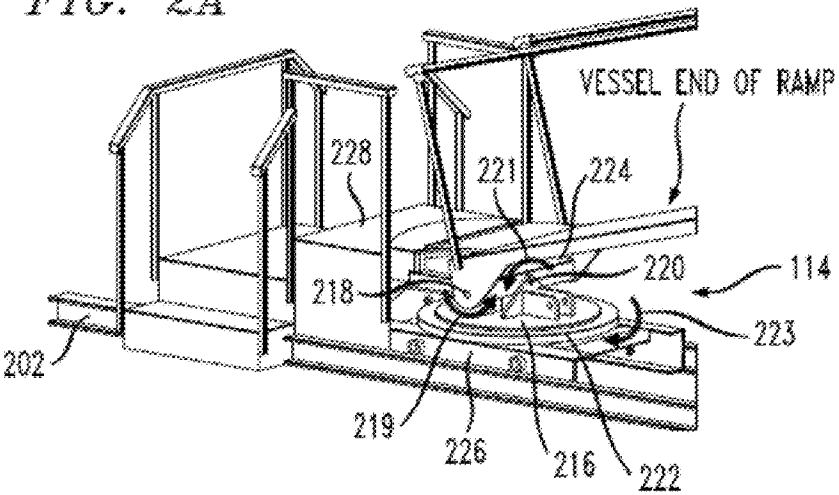
FIG. 2A depicts a perspective view of the vessel end of a ramp of the crew transfer system of FIG. 1. This Figure depicts an embodiment of a first coupling that provides three rotational degrees-of-freedom, as well as a "movable platform," which is capable of moving along guide rails to provide a single linear degree-of-freedom.

FIG. 2A depicts details of the vessel end of ramp 112 and first coupling 114 by which the ramp couples to transfer vessel 100. First coupling 114 comprises first mechanism 216 and movable platform 226.

First mechanism 216 comprises hinge pin 218, roll pin 220, and bearing 222. Roll pin 220 is disposed on bearing 222, and hinge pin 218 is disposed on member (e.g., bar, etc.) 224 that rotates about the roll pin. Referring now to FIG. 2B as well as FIG. 2A, hinge pin 218 enables the vessel-end of ramp 112 to pitch about pitch axis 219. Roll pin 220 enables the first end of ramp 112 to roll about roll axis 221. Bearing 222 enables the first end of ramp 112 to yaw about yaw axis 223. The various pins and bearings of first mechanism 216 are arranged, as shown, to provide three rotational degrees-of-freedom to the vessel-end of ramp 112.

In some embodiments, first mechanism 216 is arranged so that hinge pin 218 provides for up to +30 degrees of pitch (about axis 219), roll pin 220 provides for roll of up to −15 to +15 degrees (about axis 221), and bearing 222 provides for yaw of up to −30 to +30 degrees (about axis 223).

First mechanism 216 is disposed on movable platform 226. Platform/steps 228 are disposed on movable platform 226 as well. In the illustrative embodiment, movable platform 226 engages guide 102, which is disposed on transfer vessel 100 (see, FIG. 1). In the illustrative embodiment, guide 102 is implemented as I-beam-like guide rails 202, as depicted in FIG. 2A.

Guide rails 202 are oriented along a bow-to-stern orientation (as shown for guide 102 in FIG. 1). In some embodiments, guide rails 202 are rigidly attached along their full length to transfer vessel 100. In some other embodiments, the guide rails are pivotably attached to the transfer vessel, wherein the attachment point is relatively closer to the bow of vessel 100.

Movable platform 226 and guide rails 202 enable the vessel-end of ramp 112 to translate in a single direction; namely, along rails 202. In this manner, first coupling 114 imparts three rotational degrees of freedom and one translational degree of freedom to the vessel end of ramp 112. Note that in the illustrative embodiment, platform/steps 228 translate with movable platform 226.

Figure 3:
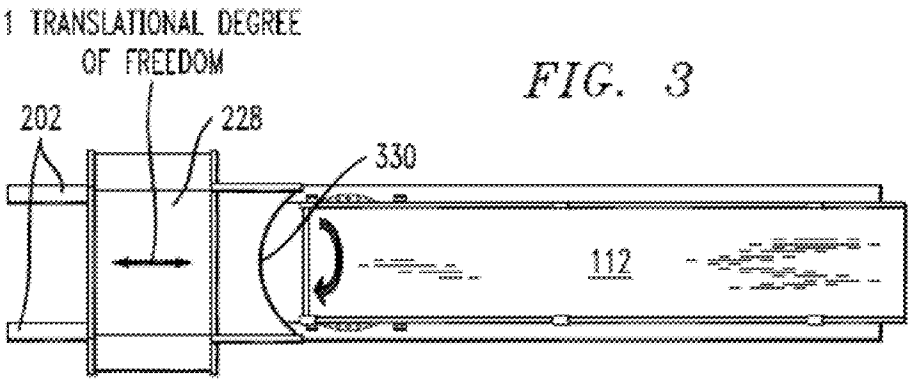
FIG. 3 depicts a top view of FIG. 2A. This Figure illustrates that in addition to the rotational degrees of freedom, the end of the ramp is has a single translational (linear) degree of freedom by virtue of the movable platform and guides.

FIG. 3 depicts a top view of the vessel end of ramp 112. Interface 330 between edge of platform/steps 228 and ramp 112 is curved (i.e., the respective adjacent edges of the platform/steps and the ramp are curved) to permit unfettered rotational movement (i.e. yaw) of vessel-end of ramp 112. The translational movement of the first end of ramp 112 along guide rails 202 is depicted.

Figure 4:
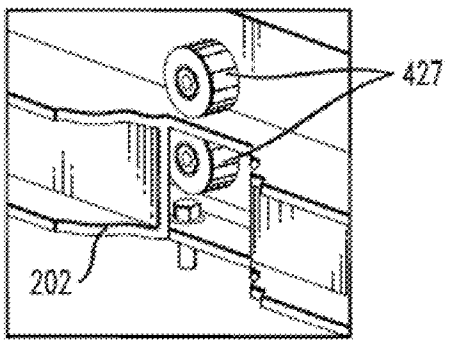
FIG. 4 depicts details of an embodiment of the movable platform, wherein the platform includes rollers that cooperate with guide rails on the transfer vessel.

FIG. 4 depicts details of an embodiment of movable platform 226 wherein the platform has rollers 427 that engage guide rails 202. This enables movable platform 226 to move along the guide rails as the second end of ramp 112 is raised to couple to (or lowered to decouple from) oil rig 190.

Figure 5:
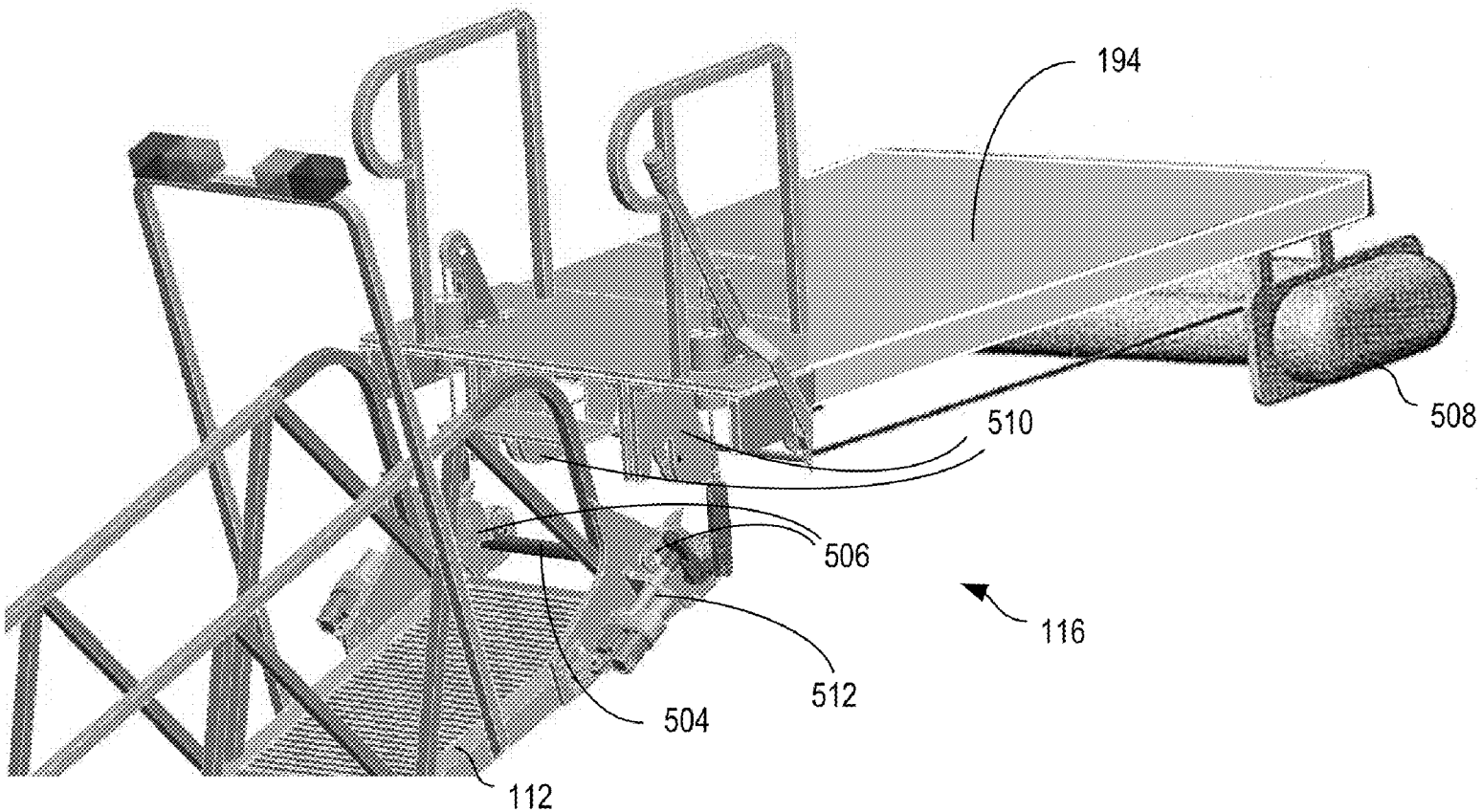
FIG. 5 depicts second coupling 116 in accordance with the illustrative embodiment of the present invention.

FIG. 5 depicts second coupling 116, whereby ramp 112 couples to base 194 of stairs 192 on oil rig 190. Second coupling 116 comprises coupling member 502 that depends from base 194 and latch 504 that depends from the "rig" end of ramp 112.

As described in further detail below in conjunction with FIGS. 6 and 7A through 7C, latch 504 and coupling member 502 engage one another to couple ramp 112 to oil rig 190.

Figure 6:
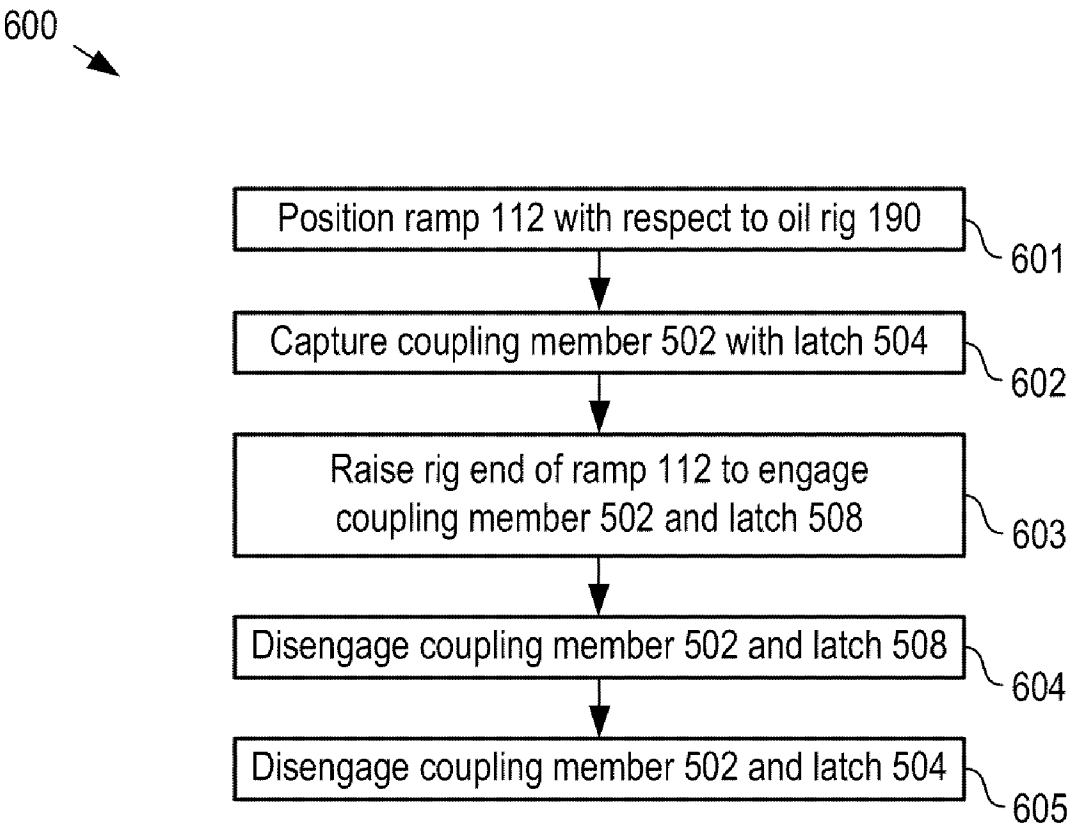
FIG. 6 depicts a method comprising operations suitable for coupling ramp 112 and base 194 in accordance with the illustrative embodiment of the present invention.

FIG. 6 depicts a method comprising operations suitable for coupling ramp 112 and base 194 in accordance with the illustrative embodiment of the present invention. Method 600 begins with operation 601, wherein ramp 112 is positioned with respect to oil rig 190. Method 600 is described herein with reference to FIGS. 7A-7C and continuing reference to FIGS. 1-5.

Ramp 112 is put into a proper position by maneuvering vessel 100 with respect to oil rig 190 such that coupling member 502 can be lowered from base 194 toward latch 504.

Figures 7A, 7B, 7C, 7D:
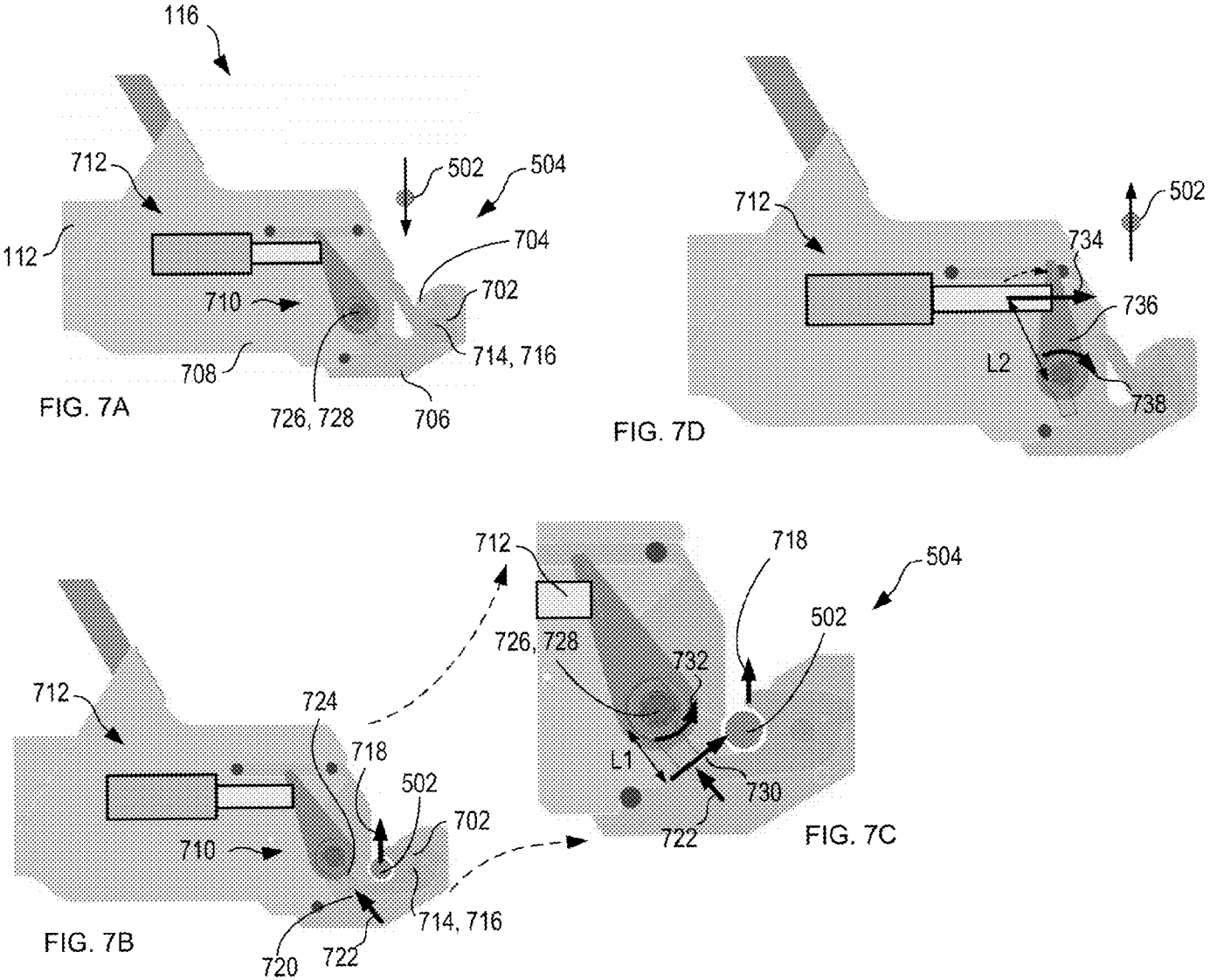
FIG. 7A depicts a schematic drawing of a side view of second coupling 116, prior to the capture of coupling member 502 by latch 504.
FIG. 7B depicts a schematic drawing of a side view of second coupling 116, after the capture of coupling member 502 by latch 504.
FIG. 7C depicts an enlarged view of latch 504 and captured coupling member 502.
FIG. 7D depicts a schematic drawing of a side view of second coupling 116, after the release of coupling member 502 by latch 504, in accordance with the illustrative embodiment of the present invention.

FIG. 7A depicts a schematic drawing of a side view of second coupling 116, prior to the capture of coupling member 502 by latch 504.

Latch 504 comprises cam/latch 702, plate 706, interface 708, actuation lever 710, and actuator 712.

Interface 708 is rigidly mounted to the rig end of ramp 112. Plate 706, which provides a mounting surface for cam/latch 702 and actuation lever 701, mates with interface 708. As a result, latch 504 depends from ramp 112. Interface 708 provides a mounting surface for actuator 712.

Cam/latch 702 is an element that is rotatable about pin 714, which defines rotation axis 716. Prior to the coupling of ramp 112 and platform 190, cam/latch 702 resides in a fully counter-clockwise rotated position, as shown in FIG. 7A. Cam/latch 702 comprises a torsional spring (not shown) that provides a constant restoring force in the counter-clockwise direction. It will be clear to one skilled in the art, after reading this specification, how to provide cam/latch 702 with a mechanical restoring force in the counter-clockwise direction by alternative means.

Cam/latch 702 comprises seat 704, which is suitable for receiving coupling member 502. Seat 704 has a curved surface to enable rotation of latch 116 about coupling member 502 after latch 116 and coupling member 502 are engaged.

Actuation lever 710 is a rigid lever for engaging cam/latch 702. Actuation lever 710 is rotatable about pin 726, which defines rotation axis 728. Actuation lever 710 comprises lever arms 724 and 736.

At operation 602, latch 504 captures coupling member 502. By virtue of the capture of coupling member 502 by latch 504, ramp 112 and stationary platform 190 are coupled. It should be noted, however, that operation 602 couples the ramp and platform through the relatively flexible cables that extend from hoist 508 to coupling member 502.

FIG. 7B depicts a schematic drawing of a side view of second coupling 116, after the capture of coupling member 502 by latch 504.

FIG. 7C depicts an enlarged view of latch 504 and captured coupling member 502.

As coupling member 502 is lowered into seat 704, it forces a rotation of cam/latch 702 clockwise about axis 716 until tongue 720 engages lever arm 724 of actuation lever 710. Once engaged with tongue 720, actuation lever 710 inhibits rotation of cam/latch 702 about axis 716.

At operation 603, hoist 506 raises coupling member 502, which pulls the rig end of ramp 112 toward base 194. The weight of ramp 112 induces load force 718 on the upper portion of cam/latch 702. Load force 718 induces coupling force 722 at tongue 720. By virtue of the design of cam/latch 702, at least a portion of coupling force 722 is directed normal to pin 726. In some embodiments, the magnitude of coupling force 722 is less than the magnitude of load force 718. As depicted in FIG. 7C, coupling force 722 gives rise to friction force 730. Friction force 730 is directed on lever arm 724 at a distance L1 from axis 728. As a result, coupling force 722 induces torque 732 about axis 728. Torque 732 resists rotation of actuation lever 710 about axis 728.

Actuation lever 710 and cam/latch 702, once engaged, define a substantially mechanically bi-stable mechanical system. This mechanically bi-stable system is held in place by coupling force 722, which induces friction force 730 and its associated torque 732. This mechanically bi-stable system is triggered out of its bi-stable state by the application of an opposing torque of sufficient magnitude to overcome torque 732.

Once the rig end of ramp 112 reaches base 194, coupling member 502 is captured by latch 508, which depends from the underside of ramp 192. As a result, the coupling of ramp 112 and platform 190 is made less flexible, since translational motion of coupling member (and the rig end of ramp 112) is restricted. Each of latches 508 and 504 allow rotation of coupling member 502 about its longitudinal axis, however.

At operation 604, latch 510 is actuated to release coupling member 504 in preparation for decoupling ramp 112 and stationary platform 190. Once latch 510 is actuated, hoist 506 lowers rig end of ramp 112 back toward vessel 100 to enable securing the ramp at the vessel.

At operation 605, actuator 712 applies actuation force 732 to lever arm 736 of actuation lever 710. Actuator 712 is a linear actuator, such as a hydraulic or pneumatic piston, solenoid, magnetic actuator, and the like. It will be clear to one skilled in the art how to specify, make, and use actuator 712. In some embodiments, actuator 712 is a rotary actuator coupled with actuation lever 710.

As depicted in FIG. 7D, force 732 is applied to lever arm 736 at a distance L2 from axis 728. As a result, force 732 induces torque 738 about axis 728. Since L2 is greater than L1, torque 738 can overcome torque 732 and induce rotation of actuation lever 710 even when force 734 is relatively smaller than friction force 730. In other words, second coupling 116 is physically arranged to provide a mechanical advantage that enables a small actuation force to disengage actuation lever 710 from cam/latch 702 and thereby enable latch 504 to release coupling member 502. In some embodiments, the actuation force required for decoupling coupling member 502 and latch 504 (and, therefore, ramp 112 and stationary platform 190) is less than the load force induced on coupling 116 by the coupling of ramp 112 and stationary platform 190.

Once cam/latch 702 and actuation lever 710 are disengaged, cam/latch 702 is free to rotate clockwise to a position in which it releases coupling member 502. Upon the release of coupling member 502 by cam/latch 702, hoist 506 retracts coupling member 502 back into engagement with latch 510 at base 194.

It should be noted that operation 605 can be carried out at any time after operation 602. In some instances, it is desirable to disengage coupling member 502 and latch 504 while ramp 112 is being raised into position for coupling with base 194. For example, if vessel 100 is hit by a rogue wave, when an unexpected condition occurs, or in an emergency situation. Coupling 116 enables quick release of coupling member 502 by latch 504 in such situations.

It is to be understood that the disclosure teaches just one example of the illustrative embodiment and that many variations of the invention can easily be devised by those skilled in the art after reading this disclosure and that the scope of the present invention is to be determined by the following claims.

What is claimed is:

1. A system for transferring personnel or material from a transport vessel to a stationary platform at sea, wherein the system comprises:

a ramp having a first end and a second end, wherein in use, the first end is coupled to the transport vessel and the second end is coupled to the stationary platform;

a first coupling, wherein the first coupling couples together the first end and the transport vessel, and wherein the first coupling provides three rotational degrees-of-freedom and no more than one translational degree-of-freedom to the first end; and a second coupling for coupling the second end and the stationary platform, wherein the second coupling comprises;

a coupling member that depends from the stationary platform; and a latch for capturing the coupling member to couple the second end and the stationary platform, wherein the latch depends from the second end, and wherein a load force is induced on the latch when the second end and the stationary platform are coupled, and wherein the load force induces a coupling force that inhibits the release of the coupling member by the latch;

wherein the second coupling is physically arranged to enable the latch to release the coupling member in response to receipt of an actuation force that is less than the coupling force.

2. The system of claim 1 wherein the latch is physically arranged to induce the decoupling force such that the decoupling force is greater than the coupling force when the actuation force is less than the load force.

3. The system of claim 1 wherein the latch comprises an actuation lever that is rotatable about a first axis, and wherein the coupling force is applied to the actuation lever at a first distance from the first axis, and wherein the actuation force is applied to the actuation lever at a second distance from the first axis, and further wherein the second distance is greater than the first distance.

4. The system of claim 3 wherein the coupling force a first torque about the first axis, and wherein the actuation force induces a second torque about the first axis, and further wherein the second torque is greater than the first torque.

5. The system of claim 1 wherein the latch comprises:

a cam/latch having a first position and a second position, wherein the cam/latch secures the coupling member when in the first position, and wherein the cam/latch releases the coupling member when in the second position; and an actuation lever that engages the cam/latch to inhibit movement of the cam/latch from the first position to the second position;

wherein the cam/latch moves to the first position and engages the actuation lever when the cam/latch captures the coupling member;

wherein the coupling force inhibits the disengagement of the actuation lever and the cam/latch; and wherein the latch is physically arranged such that the actuation force disengages the actuation lever from the cam/latch.

6. The system of claim 5 wherein the actuation lever is rotatable about a first axis, and wherein the actuation lever receives the coupling force at a first distance from the first axis and the actuation force at a second distance from the first axis, and further wherein the second distance is greater than the first distance.

7. The system of claim 1 wherein the coupling member depends from a structure that depends from the stationary platform.

8. A system for transferring personnel or material from a transport vessel to a stationary platform at sea, wherein the system comprises:

(1) a ramp having a first end and a second end, wherein in use, the first end is coupled to the transport vessel and the second end is coupled to the stationary platform;

(2) a first coupling, wherein the first coupling couples together the first end and the transport vessel, and wherein the first coupling provides three rotational degrees-of-freedom and no more than one translational degree-of-freedom to the first end; and (3) a second coupling for coupling the second end and the stationary platform, wherein a load force is induced on the second coupling when the ramp and the stationary platform are coupled, and wherein the second coupling comprises;

(a) a coupling member that depends from the stationary platform;

(b) a cam/latch that depends from the second end, wherein the cam/latch is rotatable about a first axis between a first position and a second position, and wherein the cam/latch secures the coupling member when in the first position, and further wherein the cam/latch releases the coupling member when in the second position; and (c) an actuation lever that engages the cam/latch to inhibit movement of the cam/latch from the first position to the second position;

wherein the cam/latch moves to the first position and engages the actuation lever when the cam/latch captures the coupling member;

wherein a coupling force that is based on the load force inhibits the disengagement of the actuation lever and the cam/latch; and wherein the latch is physically arranged such that an actuation force that is less than the load force induces a decoupling force that is greater than the coupling force, and wherein the decoupling force disengages the actuation lever from the cam/latch.

9. The system of claim 8 wherein the actuation lever is rotatable about a first axis, and wherein the actuation force is directed on the actuation lever at a first distance from the first axis to induce the decoupling force as a first torque about the first axis, and wherein the coupling force is directed on the actuation lever at a second distance from the first axis to induce a second torque about the first axis, and further wherein the first torque is greater than the second torque.

10. The system of claim 8 wherein the coupling member depends from a structure that depends from the stationary platform.

11. A method for coupling a transport vessel and a stationary platform at sea, wherein the method comprises:

positioning a ramp having a first end and a second end, wherein the ramp is positioned with respect to the stationary platform, and wherein the first end is coupled to the transport vessel at a first coupling that provides three rotational degrees-of-freedom and no more than one translational degree-of-freedom to the first end of the ramp, and further wherein the second end comprises a latch for coupling with the stationary platform;

capturing a coupling member with the latch, wherein the coupling member depends from the stationary platform, and wherein a load force is induced on the second coupling when the second end and the stationary platform are coupled, and further wherein the load force induces a coupling force that inhibits the latch from releasing the coupling member; and decoupling the ramp from the stationary platform by applying an actuation force to the second coupling, wherein the actuation force induces a decoupling force that enables the latch to release the coupling member, and wherein the actuation force is less than the load force.

12. The method of claim 11 further comprising providing the second coupling:

wherein the second coupling comprises the latch, and wherein the latch depends from the second end;

wherein the latch comprises an actuation lever and a cam/latch that rotates between a first position in which the cam/latch secures the coupling member and a second position in which the cam/latch releases the coupling member;

wherein the actuation lever engages the cam/latch to inhibit rotation of the cam/latch from the first position to the second position; and wherein the coupling force inhibits disengagement of the actuation lever from the cam/latch.

13. The method of claim 12 wherein the actuation force is applied to the actuation lever, and wherein the actuation force disengages the actuation lever from the cam/latch and enables the cam/latch to rotate to the second position and release the coupling member.

14. The method of claim 13 wherein the actuation force is applied to the actuation lever such that the actuation force induces a first torque for rotating the actuation lever about a first axis, and wherein the coupling force induces a second torque that inhibits rotation of the actuation lever about the first axis, and further wherein the first torque is greater than the second torque.

15. The method of claim 13 wherein the actuation force is applied to the actuation lever at a first distance from a first axis, and wherein the coupling force is applied to the actuation lever at a second distance from the first axis, and further wherein the first distance is greater than the second distance.

* * * * *